US009482443B1

(12) United States Patent
Backman

(10) Patent No.: US 9,482,443 B1
(45) **Date of Patent: *Nov. 1, 2016**

(54) HFC BLEND REFRIGERATION SYSTEM WITH INTERNAL R32 BLEND SUBCOOLING

(71) Applicant: BMIL, Morehead City, NC (US)

(72) Inventor: Thomas J. Backman, Morehead City, NC (US)

( * ) Notice: Subject to any disclaimer, the term of this patent is extended or adjusted under 35 U.S.C. 154(b) by 1025 days.

This patent is subject to a terminal disclaimer.

(21) Appl. No.: 13/626,806

(22) Filed: Sep. 25, 2012

Related U.S. Application Data

(63) Continuation-in-part of application No. 12/413,926, filed on Mar. 30, 2009, now Pat. No. 8,291,723.

(51) Int. Cl.
*F24F 13/20* (2006.01)

(52) U.S. Cl.
CPC ..... *F24F 13/20* (2013.01)

(58) Field of Classification Search
CPC .. F24F 13/20; F25D 23/006; F25B 2400/075
USPC ..... 62/116, 122, 180, 298, 502, 510, 511
See application file for complete search history.

(56) References Cited

U.S. PATENT DOCUMENTS

| | | | | |
|---|---|---|---|---|
| 3,299,654 | A * | 1/1967 | Leonard, Jr. | 62/116 |
| 4,448,030 | A * | 5/1984 | Moss | 62/79 |
| 7,062,930 | B2 * | 6/2006 | Rayburn | 62/173 |
| 8,291,723 | B1 * | 10/2012 | Backman | 62/502 |
| 2013/0139539 | A1 * | 6/2013 | Yamashita | F25B 30/02 62/324.6 |

* cited by examiner

*Primary Examiner* — Melvin Jones

(57) ABSTRACT

A refrigeration system having a main circuit including a main compressor thermally coupled with a secondary or subcooling circuit. The main circuit uses a HFC blend, such as but not limited to, R125/R143A blend or R32/R125/R134A blend as a refrigerant and the subcooling circuit uses an R32 blend. Some embodiments may include more than one main compressor. Some embodiments of the secondary circuit may include more than one secondary compressor. The combined system of differing refrigerants provides increased efficiencies and reduced Global Warming Potential (GWP) over single refrigerant systems for low and medium temperature refrigeration applications.

19 Claims, 5 Drawing Sheets

HFC BLEND REFRIGERATION SYSTEM WITH INTERNAL R32 BLEND SUBCOOLING

RELATED APPLICATION

This application is a continuation-in-part application that claims the benefit of U.S. Utility application Ser. No. 12/413,926 filed on Mar. 30, 2009 and entitled "R125 and R143A Blend Refrigeration System with Internal R32 Blend Subcooling".

FIELD OF THE INVENTION

The present invention relates to refrigeration and, in particular to low and medium refrigeration systems having reduced environmental impact.

BACKGROUND OF THE INVENTION

Issues with ozone depletion have resulted in an R22 phase out that begins in the year 2010. This has driven the majority of commercial refrigeration installations toward R125 and R143A blend refrigerants having the required zero Ozone Depletion Potential (ODP). On the negative side, these refrigerants have lower system efficiencies than R22 and also have high Global Warming Potential (GWP).

Further developments in refrigeration cooling systems have led to R-32/R-125/R-134A blend refrigerants having a lower Global Warming Potential_(GWP). As a comparison to R-32/R-125/R-134A blend refrigerants, R407A has a GWP of 2110 and R407C has a GWP of 1770, but R125 and R143 blend R404A has a GWP of 3920 and R507 has a GWP of 3985.

A downside of R407A and R407C refrigerants, is that they have large refrigerant glide issues, which can make cooling capacity unstable in the presence of flash gas at the expansion device. The present invention substantially eliminates and/or prevents any occurrence of flash gas at the expansion device due to the refrigerant liquid subcooling. By definition subcooling means that the refrigerant liquid is too cold for the presence of flash gas. Therefore this invention will enhance the performance and reliability of R-32/R-125/R-134A blend refrigerants.

Refrigerant subcooling has been used to raise the system efficiencies. Mechanically coupled subcooling, in particular, has been used for larger refrigeration and air conditioning systems employing the same or similar refrigerants for both the main and the subcooling circuits. The efficiency increase, however, has not been accompanied by any meaningful reduction in GWP.

Certain blended refrigerants are available having zero ODP and low GWP are available for air conditioning application, but have not seen use in commercial refrigeration installations because they have performance issues that make them less practical than alternative refrigerants, i. e. very high discharge pressures, which means large refrigerant pipes with limited pressure ratings cannot be applied to these refrigerants, or significant temperature glide, which means there can be more than one temperature in a refrigerant system at a given pressure. Both present engineering and design problems for service contractors in commercial installations with long pipe runs.

Table 1 below is a summary chart of the characteristics of the refrigerants mentioned above. The data in this table is readily available as common knowledge in commercial refrigeration.

TABLE 1

| Refrigerant | GWP | Application | Discharge Pressure at 120 F. Condensing |
|---|---|---|---|
| R404A | 3859 | Refrigeration | 310 psig |
| R507 | 3925 | Refrigeration | 322 psig |
| R410A | 1997 | Air Conditioning | 418 psig |
| R407C | 1770 | Refrigeration & Air Conditioning | 266-300 psig |
| R22 | 1780 | Refrigeration & Air Conditioning | 260 psig |
| R407A | 2110 | Refrigeration | 284 psig |

The commercial refrigeration systems with subcooling have typically been large, field assembled systems and they have often been problematic from an operational standpoint. The combination of high installed capital cost, high maintenance cost, and limited contractor experience leads refrigerant subcooling technology toward use only on refrigeration systems of 25 Hp, or larger, compressor size. This size limitation works against current public sentiment for higher system efficiency in all size applications without addressing the concurrent sentiment for lower environmental impact.

SUMMARY OF THE INVENTION

The present invention overcomes the above limitations by providing a low and medium temperature HFC blend refrigeration system manufactured for improved efficiency and lessened environmental impact with a two part design comprising a dual condensing unit located remote from the refrigeration applicant and an evaporator located for supplying the refrigeration capacity. The condensing unit is a fully assembled package comprising a pair of condensers and associated compressors. One condenser and one compressor is assembled with an expansion device and evaporator/heat exchanger in a preassembled subcooling circuit circulating an air conditioning refrigerant and operating efficiently in an intended air conditioning cycles. The air conditioning refrigerant has an ODP of substantially zero and a GWP less than 2000, preferably an R32 blend refrigerant, such as R-410A or R407C. Other embodiments include one condenser and two compressors. Adding a second, third, or fourth compressor gives the added benefit of more precise cooling capacity control. The other condenser and compressor are assembled in the condensing unit and connected by field installed lines to the main evaporator forming a main refrigeration circuit circulating a low or medium temperature refrigeration refrigerant and operating efficiently in the intended refrigeration cycles. The refrigeration refrigerant has an ODP of substantially zero and a GWP greater than about 3500, preferably a HFC blend refrigerant, such as but not limited to, an R125/R143A blend, such as R404A or R507. In other embodiments, the refrigeration refrigerant has an ODP of substantially zero and a GWP greater than about 3500, preferably an HFC blend refrigerant, such as but not limited to, an a R32/R125/R134A blend, such as R407A or R407C. Other embodiments include two compressors in the condensing unit. Adding a second, third, or fourth compressor gives the added benefit of more precise cooling capacity control. The main refrigeration circuit is thermally coupled internally in the condensing unit with the subcooling evaporator for cooling the liquid refrigerant from the main condenser to provide the subcooling. The resulting combination of the two independent and differing cycles provides a significant reduction in main compressor power requirement resulting in efficiency increase, and a reduction in required flow rate of the main refrigerant resulting in a lowered environmental impact. The refrigeration system uses remote field piping to connect the condensing unit to the evaporator with pipe runs in the range of 10 to 300 feet. The subcooling refrigeration system that is in a cascade relation to the main refrigeration system is manufactured within the same condensing unit for operation system with the R32 refrigerant blend. The system controls provide for a condensing temperature no less than 20° F. higher than the subcooled liquid temperature. The main refrigeration system expansion device is designed for operation matched with the subcooled liquid temperature and resulting decreased refrigerant mass flow. The subcooling circuit has short liquid and suction line pipe runs of 20 feet or less. The main refrigeration system is installed with field installation of refrigeration liquid line insulation to avoid heat gain that erodes efficiency improvement and capacity loss. The condensers are placed in side by side relation in the condensing unit and provide for independent parallel condenser cooling. Condenser cooling may be made with a cooling tower and water flow instead of ambient air flow. In this design, the water must flow to the two condensers ion a parallel flow arrangement.

In one aspect, the invention provides refrigeration system including a main refrigeration circuit including a main compressor (or compressors), a main condenser, a main expansion device, and a main evaporator and circulating a low temperature or medium temperature refrigerant of an HFC blend, such as but not limited to, R-125/R-143a blend or of R-32/R-125/R-134A blend; a secondary refrigeration circuit including a secondary compressor (or compressors), a secondary condenser, a secondary expansion device, and a secondary evaporator and circulating an air conditioning refrigerant of a R-32 blend, said main refrigeration circuit being coupled to a liquid line of said secondary refrigeration circuit; a condenser unit having a housing enclosing said main condenser and said secondary condenser in parallel spaced relation, said main compressor and said secondary compressor, said secondary expansion device and said secondary evaporator; a ventilation inlet and a ventilation outlet in said housing of said condenser unit; fan means in said housing for circulating air between said inlet and said outlet and across said main condenser in parallel flow paths; conduit means interconnecting said secondary condenser, said secondary compressor, said expansion device and said secondary. Further, in the system the low temperature or medium temperature refrigerant is R404A or R-507 or R407A or R407C and air conditioning refrigerant is R-410A or R-407C. The refrigeration system may have a condensing temperature of the main condenser that is 20° F. or more above the temperature of secondary evaporator. The refrigeration system may have a condensing temperature of said secondary condenser less than 120° F. Additionally, the secondary refrigeration system is interconnected with conduit means not exceeding 10 feet in individual length. For 407C, the conduit means provides downward liquid flow from said secondary condenser at a flow rate preventing the flow of vapor to said secondary control device, and/or less than 125 feet per minute. Preferably, the refrigeration system has the main refrigeration circuit thermally coupled to said secondary refrigeration circuit at the secondary evaporator.

In another aspect, the invention provides a method of replacing a refrigeration system consisting of a condensing unit operatively connected in a refrigeration circuit using R22 as a refrigerant to a remotely located evaporator by a liquid line from a condenser and suction line to one or more compressors including removing the refrigerant from the circuit; severing said liquid line and said suction line; removing said condenser unit; providing a replacement condenser unit having a housing enclosing a secondary cooling circuit serially consisting a secondary condenser, one or more secondary compressors, a secondary expansion valve, and a secondary evaporator and carrying a secondary refrigerant having a GWP less than about 2000 and a ODP of substantially 0; said housing further enclosing one or more replacement compressors having an inlet line and serially connected with a replacement condenser having an outlet line thermally coupled with said secondary evaporator; connecting the severed liquid line to said outlet line and said severed suction line to said inlet line of said replacement condenser unit to provide a replacement main refrigeration circuit; and charging said replacement main refrigeration circuit with a replacement refrigerant having a GWP greater than about 3500 and a ODP of substantially 0.

One feature of the invention is a low and medium temperature refrigeration system having increase efficiency and reduced Global Warming Potential.

Another feature of the invention is a refrigeration system using a main circuit with a refrigeration fluid thermally coupled with a subcooling circuit using an air conditioning fluid.

A further feature of the invention is a refrigeration system using subcooling usable with lower powered compressors.

Another feature of one or more embodiments is a low or medium temperature system having two or more compressors. A further feature of one or more embodiment is an air conditioning system having two or more compressors.

BRIEF DESCRIPTION OF THE DRAWINGS

The above and other features and advantages of the invention will become apparent from the following description taken in conjunction with the accompanying drawings in which.

DESCRIPTION OF THE EMBODIMENTS

The present invention provides a refrigeration system wherein a R32 refrigerant blend subcooling system assists a HFC blend system, such as a R125 and R143A blend system, and/or a R32/R125/R134A blend system, to overcome the obstacles of GWP and efficiency. These R32 blends are applied to commercial refrigeration systems as reliable close coupled internal subcooling cycles with carefully selected design criteria. Such are implemented in a dual condensation unit that may be manufactured in a factory setting with the necessary engineering, repeatable assembly processes, and close quality control.

A refrigeration system with a compressor of 25 hp or less is usually installed with two major factory built components. The first component is typically a condensing unit with compressor, condenser coil, controls, and valves. Some embodiments may include more than one compressor. The second component is a unit cooler with an evaporator coil, fans, and valves. In the field, a refrigeration contractor typically connects the two major components with two pipe runs. These refrigerant pipe runs include a supply or liquid line and a return or suction line.

By utilizing mechanical refrigerant subcooling within the factory built condensing unit, part of the cooling load of a refrigeration system can be switched from a main HFC blend low temperature refrigeration circuit, such as but not limited to, R404A or R507 or R407A or R407C low temperature refrigeration circuit, to a secondary R32 blend air conditioning refrigeration system. In this case an R32 blend is utilized in a cascade fashion subcooling cycle for the HFC blend, R404A or R507 or R 407A or R407C main refrigeration system. System design, component sizing, equipment layout, and control methods are designed to allow this system of two refrigerants to operate reliably in the narrow window of trouble free operation. As a result, the main refrigerant charge of higher GWP R404A or R507 or R 407A or R407C can be reduced, and the net system efficiency can be increased dramatically.

Figure 1:
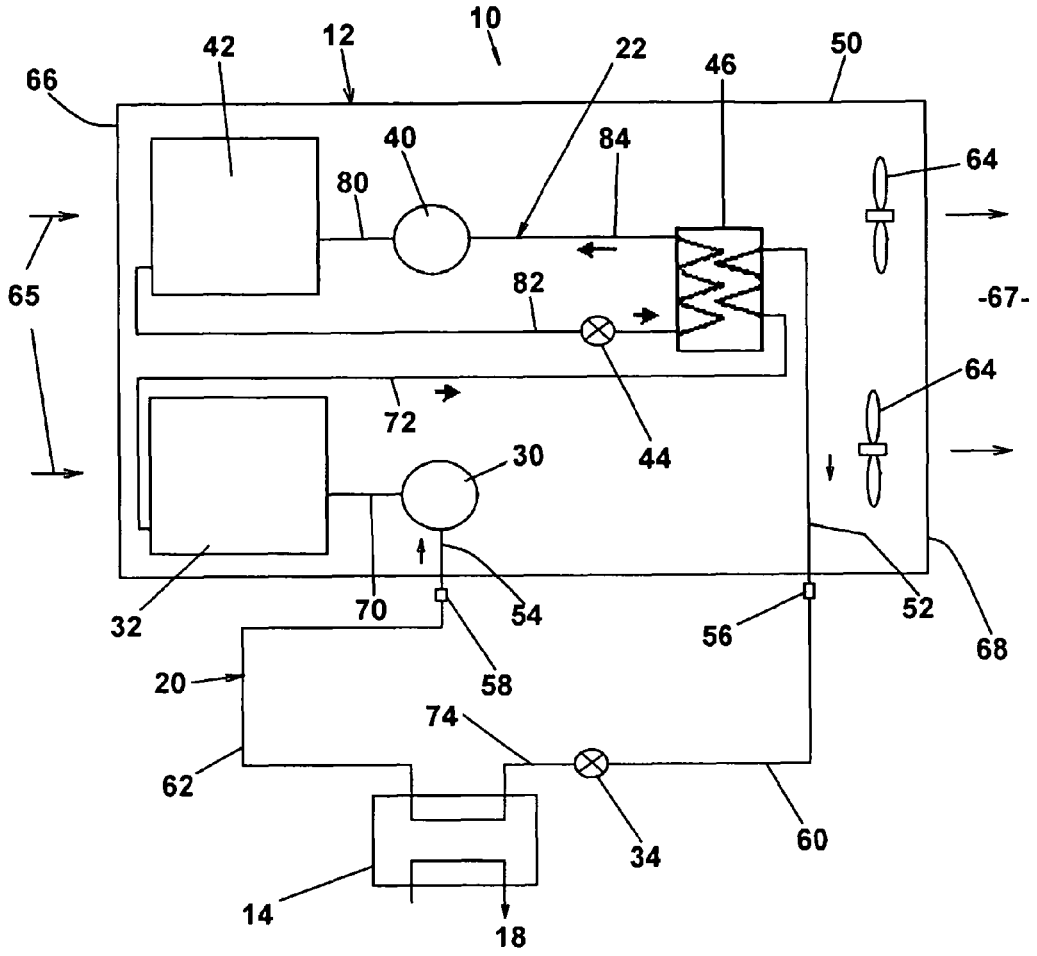
FIG. 1 is a schematic diagram of a refrigeration system in accordance with an embodiment of the invention.

Referring to FIG. 1, there is shown a refrigeration system 10 having a dual condenser unit 12 connected to a main evaporator 14 for supplying a liquid or gaseous fluid to a refrigeration application 18.

The refrigeration system 10 comprises a main circuit 20 a secondary or subcooling circuit 22. The main circuit 20 serially comprises a main compressor 30, a main condenser 32, a main expansion device 34, and the main evaporator 14. In some embodiments, main compressor 30 may comprise more than one compressor, such as but not limited to two compressors. The secondary circuit 22 serially comprises a secondary compressor 40, a secondary condenser 42, a secondary expansion device 44, and a secondary evaporator 46. In some embodiments, secondary compressor 40 may comprise more than one compressor, such as but not limited to two compressors. The main circuit 20 is thermally coupled to the secondary circuit 22 at the secondary evaporator 46. The condensing unit 12 includes a housing 50 enclosing the secondary circuit 22, and the main compressor 30 and main condenser 32 of the main circuit 20. The condensing unit 12 includes a main supply line 52 and a main return line 54. The lines 52, 54 project outwardly of the housing 50 terminating with suitable connectors 56, 58, respectively. An external supply line 60 is connected between the main supply line 52 and the main expansion device 34 at the connector 56. An external return line 62 is connected between the main return line 54 and the main evaporator 14 at connector 58. Thus for retrofit applications the condensing unit 12 may be connected to existing supply and return lines. The condensers 32, 42 are mounted disposed in parallel side-by side relation, and one or more coolant fans 64 are disposed in the housing for directing parallel flow of ambient air 65 from a housing inlet 66 to a housing outlet 68 as indicated by the arrows.

In operation, the main compressor 30 compresses the refrigerant to a hot, high pressure gas through a discharge line or pipe 70 connected to the main condenser 32. The condenser 32 may be air or water cooled and discharges waste heat and causes the hot refrigerant gas to cool down and become a warm refrigerant liquid. The warm refrigerant liquid from the condenser 32 passes through internal line or pipe 72 to subcooling heat exchanger 46. The subcooling heat exchanger 46 removes heat from the warm refrigerant liquid. This takes cooling load away from compressor 30 and makes the main refrigeration system 20 able to do more cooling per unit of power consumption. Subcooling heat exchanger 46 converts the warm refrigerant liquid to cool refrigerant liquid. The cool refrigerant liquid passes through cool refrigerant pipe 60 and enters main expansion device 34. The expansion device 34 turns the cool liquid into a cold mixture of liquid and vapor at a reduced pressure. The cold, low pressure liquid and vapor mixture passes through pipe 74 into main evaporator 14. Evaporator 14 cools the internal building or process cooling loads. By way of example and not limitation, for a cold storage facility, the evaporator 14 would be in a walk-in refrigerator or a cold storage warehouse. For a supermarket, evaporator 14 could be in a refrigerated merchandiser. For a liquid chiller, evaporator 14 would be in the cold fluid heat exchanger. There may be a multiple of evaporators connected in a parallel arrangement.

The secondary refrigeration system 22 cools an evaporator in the form of the subcooling heat exchanger 46 and is integral to the main refrigeration system 20. The secondary compressor 40 compresses refrigerant to a hot, high pressure gas through a discharge pipe 80 that leads to the secondary condenser 42. In some embodiments, secondary compressor 40 may comprise more than one compressor, such as but not limited to, two compressors. Condenser 42 discharges waste heat and causes the hot refrigerant gas to cool down and become a warm refrigerant liquid. The warm refrigerant liquid passes through a pipe 82 to the secondary expansion device 44. The expansion device 44 turns the warm refrigerant liquid into a cold mixture of liquid and vapor at a reduced pressure. The cold mixture of liquid and vapor then enter subcooling heat exchanger 46. The subcooling heat exchanger 46 is an evaporator in refrigeration system 33, which removes heat from the warm refrigerant liquid of refrigeration system 20 and gives that heat to refrigeration system 22. This takes cooling load away from compressor 30 and makes the refrigeration system 10 able to do more cooling per unit of power consumption. Cool refrigerant vapor leaves the subcooling heat exchanger 46 and travels through a cool refrigerant suction line 84 into compressor 40 where the process begins again. The EER of compressor 40 (secondary refrigeration system 22) is much higher than that of compressor 30 (main refrigeration system 20).

The main refrigeration system 12 uses a refrigeration refrigerant having a low or zero ODP and a GWP of greater than 3500. R404A or R507 or R407A or R407C, HFC blends, such as but not limited to, of R125 and R143a or R32/R125/R134A, are examples of suitable regulatory acceptable refrigerants. For refrigeration applications, these refrigerants, while acceptable, negatively have a relatively low efficiency and a high GWP. These drawbacks are overcome with the secondary circuit refrigerant, an R32 blend such as R407C and R410A. These blends because of high suction temperatures are used directly only in air conditioning applications and not usable in low discharge temperature refrigeration. These blends, however, have the desirable attributes of zero ODP and low GWP of less than about 2000. In the present refrigeration system, the use of the incompatible refrigerants in the coupled circuits provides a reduction in cooling load at the main evaporator providing a reduction in the main refrigerant quantity and offsetting the GWP penalty of the main refrigeration circuit, and the use of reduced compressor power reducing the operating costs of the installation to cool by way of example a cold storage facility, supermarket, or liquid chiller.

Figure 2:
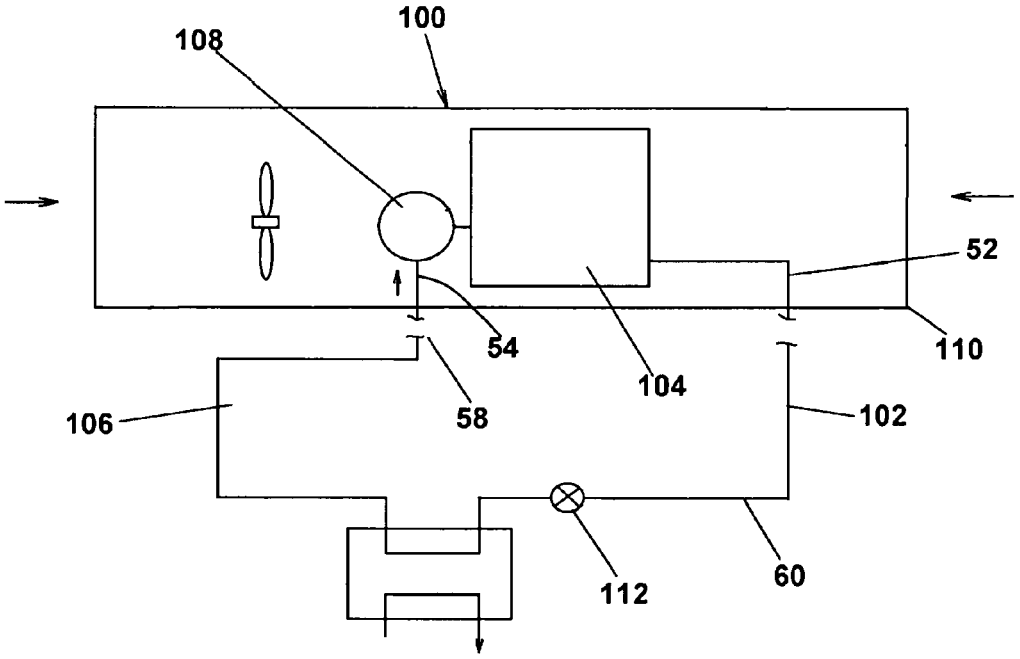
FIG. 2 is a schematic diagram for using the refrigeration system in replacement for an R22 system.

The system can be used for new installations or for replacement of R22 systems. For replacement, as shown in FIG. 2, the original condenser unit 100 is severed from the liquid line 102 from the condenser 104 and the suction line 106 of the compressor 108 adjacent the condenser unit housing 110 after removing the refrigerant from the system.

Thereafter, the condensing unit as described above is attached to the lines 102 and 106 and the main refrigeration circuit recharged with the R404A or R507 or R 407A or R407C refrigerant. The evaporation device 112 may be replaced as required for the new system.

Since more than 90% of the power consumption of a refrigeration system is used by the compressor, refrigeration systems are often rated on the Energy Efficiency Ratio (EER) of the compressor in the system. EER is a ratio of compressor cooling capacity in btu/hr over watts of power input to the compressor. Conversely some engineers focus on Coefficient of Performance (COP) of a refrigeration system or a refrigeration compressor. The COP of a compressor times 3.413 equals the EER of the same compressor (COP×3.413=EER).

Table 2 below is a summary chart of the efficiency of the refrigerants used in the present embodiment. The data in this table is readily available as common knowledge in commercial refrigeration.

TABLE 2

Refrigerant Efficiency

| Refrigerant | EER at +20 F. Suction Temp. +120 F. CT | EER at −20 F. Suction Temp. +115 F. CT | ERR at +50 F. Suction Temp. +110 F. CT |
|---|---|---|---|
| R404A | 7.1 | 3.9 | N/A |
| R507 | 7.0 | 3.8 | N/A |
| R410A | N/A | N/A | 16.2 |
| R407C | 7.3 | N/A | 17.0 |
| R407A | 7.3 | 4.0 | N/A |

As shown above, the EER of an R410A or R407C compressor at the mechanical subcooling operating temperatures is 4.1 to 4.4 times that of a low temperature (−20) R404A or R507 system and 2.3 to 2.4 times that of a medium temperature (+20) R404A or R507 system.

Figure 3:
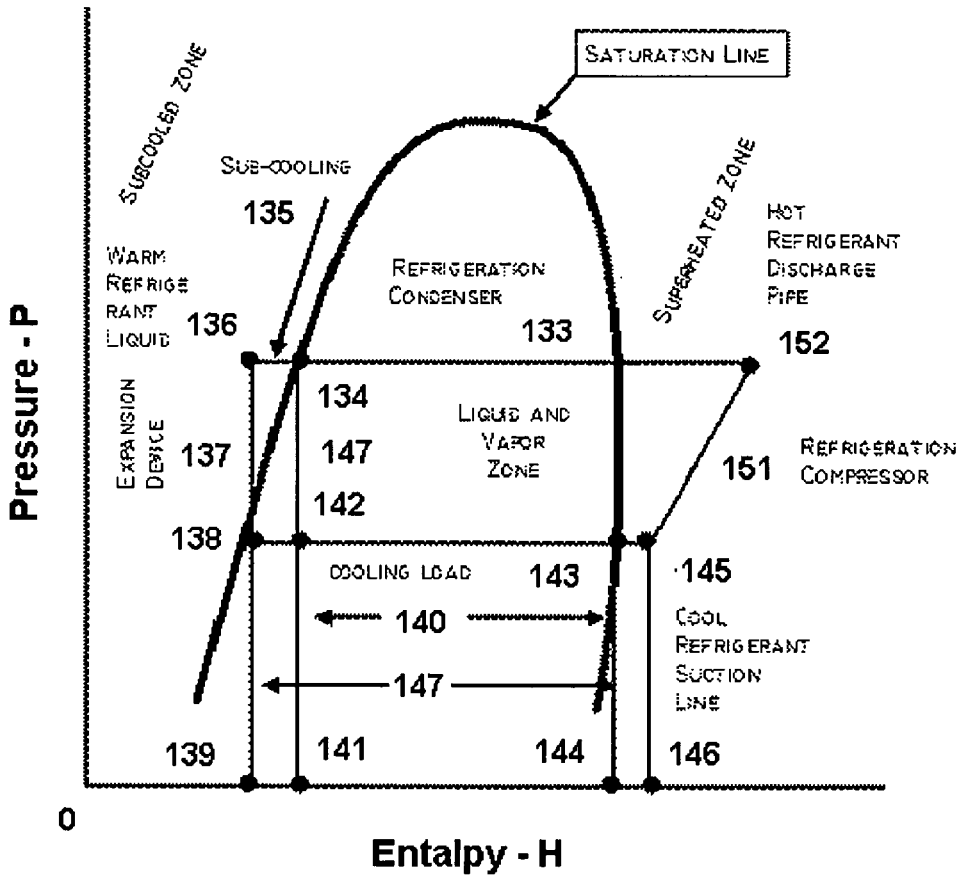
FIG. 3 is a pressure enthalpy diagram for the refrigeration system of FIG. 1.
Figure 4:
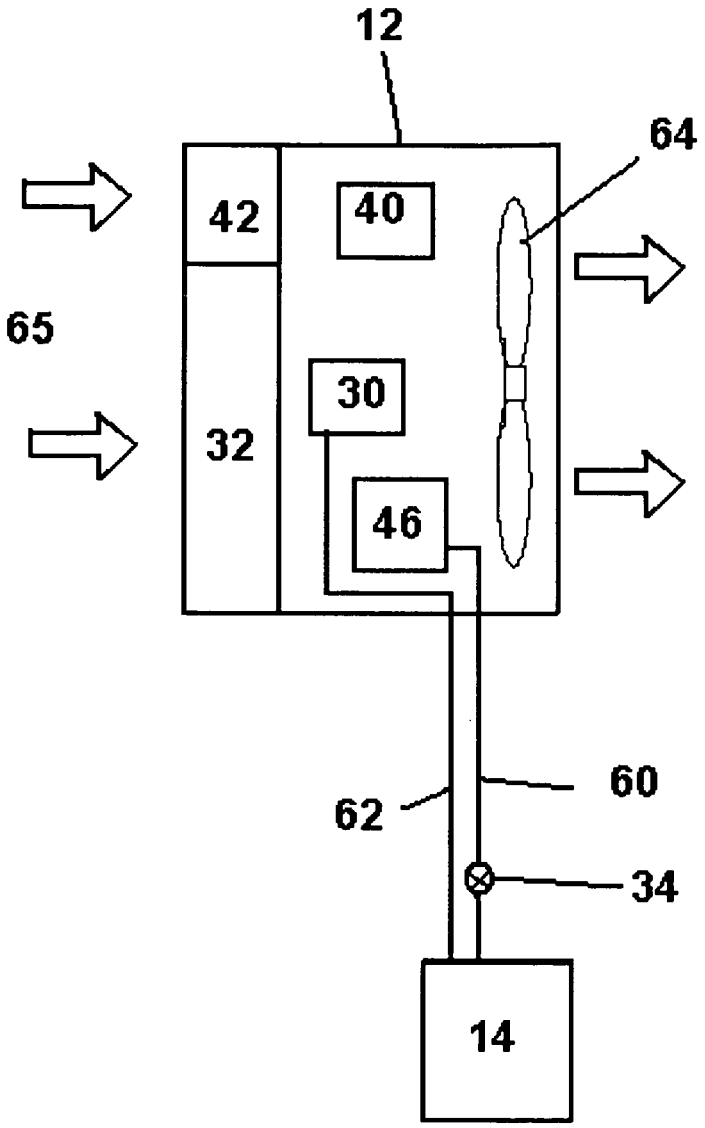
FIG. 4 is a schematic plan view of an embodiment of the condenser unit for the refrigeration system.

Referring to FIG. 3, there is shown a medium temperature refrigeration cycle with subcooling on a pressure enthalpy diagram. Refrigeration condenser 133 discharges heat to the outdoor ambient air or a water stream while condensing the refrigerant into a saturated liquid point 134 at 120° F. with an R404A enthalpy of 54.6 btu/lb as per point 141. Then the refrigerant passes through expansion device to evaporator inlet point 142 at 20° F. with an enthalpy at point 41 of 54.6 btu/lb. Without subcooling, the refrigeration effect 140 is the mass flow times the change in enthalpy from point 141 (54.6 btu/lb—same as point 142) to point 144 or 143 (94.4 btu/lb). The refrigeration effect (Q) of refrigeration system without subcooling is mass flow (m)×(94.4−54.6). Q=39.8 m. If the mass flow m is 10 lb/min (600 b/hr), then Q=23,880 btu/hr refrigeration effect. As mentioned in Table 2, this system operates at an EER of 7.1. Therefore the power consumption of the compressor applied to a prior art design is P=23,880/7.1=3,360 watts=3.36 kW.

With subcooling as described above to the refrigeration liquid line, the refrigerant liquid passes through a subcooler-evaporator 135 in the secondary refrigeration system and it is cooled at point 36 to 60° F. with an enthalpy of 32.0 btu/lb as per point 139. Then the refrigerant passes through expansion device 137 to evaporator inlet point 138 at 20° F. with an enthalpy at point 139 of 32.0 btu/lb. With subcooling, the refrigeration effect is the mass flow times the change in enthalpy from point 139 or 138 (32.0 btu/lb) to point 144 or 143 (94.4 btu/lb). If we use the refrigeration effect established above, Q=23,880 btu/hr, then the refrigeration effect (Q) of refrigeration system with subcooling is mass flow (m)×(94.4−32.0). Q=62.4 m. The mass flow of the subcooled system is 6.38 lb/min for the same heat transfer of 23,880 btu/hr, which requires 10 lb/min in a non-subcooled system, or a 36% reduction in mass flow.

In this case the subcooling system removed part of the cooling load from the main refrigeration system compressor. The subcooling cycle cooling load is a product of the refrigerant mass flow (6.38 lb/min or 383 lb/hr) and the change in refrigerant enthalpy from point 139 to point 141. The change in enthalpy from 139 to 141 is 54.6−32.0=22.6 btu/lb. Or a subcooler refrigeration cooling effect is Q=22.6 m=8,651 btu/hr. The remaining refrigeration effect to be handled by the main refrigeration system compressor is 23,880−8,651=15,229 btu/hr. As mentioned in Table 2, this main system operates at an EER of 7.1 and the subcooling system operates at an EER of 16.2. Therefore the power consumption of the new cascade subcooled system is P=(8,651/16.2)+(15,229/7.1)=530+2140=2,670 watts=2.67 kW.

The subcooled cascade example has a main system mass flow of 6.38 lb/m compared to the prior art system mass flow of 10.0 lb/m. This reduction in mass flow allows for smaller refrigeration pipes on pipe runs of 50 to 250 feet and a corresponding reduction in the size of the refrigerant charge. The R410A cascade subcooling refrigeration system refrigerant charge is small due to low mass flow and pipe runs that are five feet or less in length.

The results are summarized for R404A in Table 3 below. Similar results are obtained with R507. Whereas R404A and R507 have long established performance data from equipment manufacturers, R407A and R407C are new to the refrigeration application. Since these refrigerants are new in the market, most equipment manufacturers are describing the performance figures as preliminary. However, preliminary data estimates that similar EER improvement results will be obtained with R407A and R407C.

TABLE 3

Medium Temperature Summary

| Description | Net Cooling Btu/Hr | Power kW | Net EER | Efficiency Gain | Mass Flow | Mass Flow Reduction |
|---|---|---|---|---|---|---|
| Prior Art | 23,880 | 3.36 | 7.1 | | 10.0 lb/m | |
| Subcooled | 23,880 | 2.76 | 8.65 | 22% | 6.38 lb/m | 36.2% |

The energy savings and mass flow reduction become more significant with low temperature refrigeration systems. Therein and referring again to FIG. 3, in a low temperature refrigeration cycle, the refrigeration condenser 133 discharges heat to the outdoor ambient air or a water stream while condensing the refrigerant into a saturated liquid point 134 at 115° F. with an R404A enthalpy of 52.4 btu/lb as per point 141. Now the refrigerant passes through expansion device 147 to evaporator inlet point 142 at −20° F. with an enthalpy at point 141 of 52.4 btu/lb. Without subcooling, the refrigeration effect 140 is the mass flow times the change in enthalpy from point 141 or 142 (52.4 btu/lb) to point 144 or 143 (88.9 btu/lb). The refrigeration effect (Q) of refrigeration system without subcooling is mass flow (m)×(88.9−52.4). Q=36.5 m. If that mass flow m is 10 lb/min (600 b/hr), then Q=21.900 btu/hr refrigeration effect. This system operates at an EER of 3.8. Therefore the power consumption of the compressor applied to a prior art design is P=21,900/3.8=5,763 watts=5.76 kW.

If subcooling is added to the refrigeration liquid line, the refrigerant liquid passes through a subcooler evaporator 135 in the secondary R32 blend refrigeration system and is cooled at point 136 to 60° F. with an enthalpy of 32.0 btu/lb as per point 139. Now the refrigerant passes through expansion device 137 to evaporator inlet point 138 at −20° F. with an enthalpy at point 139 of 32.0 btu/lb. With subcooling, the refrigeration effect is the mass flow times the change in enthalpy from point 139 or 138 (32.0 btu/lb) to point 144 or 143 (88.9 btu/lb). If we use the refrigeration effect established above, Q=21,900 btu/hr, then the refrigeration effect (Q) of refrigeration system with subcooling is mass flow (m)×(88.9−32.0). Q=56.9 m. The mass flow of the subcooled system is 6.41 lb/min (385 lb/hr) for the same heat transfer of 21,900 btu/hr, which requires 10 lb/min in a non-subcooled system.

In this case the subcooling cascade system removed part of the cooling load from the main refrigeration system compressor. The subcooling cycle cooling load is a product of the refrigerant mass flow (6.41 lb/min or 385 lb/hr) and the change in refrigerant enthalpy from point 39 to point 41. The change in enthalpy from 39 to 41 is 52.4−32.0=20.4 btu/lb. That is to say that the subcooler refrigeration cooling effect is Q=20.4 m=7,854 btu/hr. The remaining refrigeration effect to be handled by the main refrigeration system compressor is 21,900−7,854=14,056 btu/hr. This main system operates at an EER of 3.9 and the subcooling system operates at an EER of 16.2. Therefore the power consumption of the new cascade subcooled system is P=(7,854/16.2)+(14,056/3.9)=485+3,603=4,089 watts=4.09 kW.

The subcooled cascade example has a main system mass flow of 6.41 lb/m compared to the prior art system mass flow of 10.0 lb/m. This reduction in mass flow allows for smaller refrigeration pipes on pipe runs of 50 to 250 feet and a corresponding reduction in the size of the refrigerant charge. The R410A cascade subcooling refrigeration system refrigerant charge is particular small due to low mass flow and pipe runs that are five feet or less in length.

The results of the above low temperature refrigeration are summarized in Table 4 below.

TABLE 4

Low Temperature Summary

| Description | Net Cooling Btu/hr | Power kW | Net EER | Efficiency Gain |
|---|---|---|---|---|
| Prior Art | 21,900 | 5.76 | 3.9 | |
| Subcooled | 21,900 | 4.09 | 5.4 | 38% |

The high efficiency/low global warming with a HFC blend refrigeration system, such as but not limited to, R125/143a blend of R404A or R507, or a R32/R125/R134A blend of R407A or R407C, refrigeration system condensing unit with internal R32 blend mechanical refrigerant subcooling requires parallel air paths for minimization of refrigeration system discharge pressures. As discharge pressures rise, compressor EER drops. Due to the low EER numbers for main refrigeration systems of R404A or R507 or R407A or R407C, the air paths for the main system condenser and the subcooling system condenser must have parallel flow, not series flow. In this way both condensers have ambient air entering the coil and the heat from one condenser does not enter the other condenser. Additionally, the R32 blend refrigerants (R410A or R407C) to be utilized in the subcooling refrigeration system are prone to high discharge pressures. If the air from the main refrigeration system condenser is in series with the subcooling refrigeration system condenser, the R32 blend causes unacceptable discharge temperatures.

Figure 5:
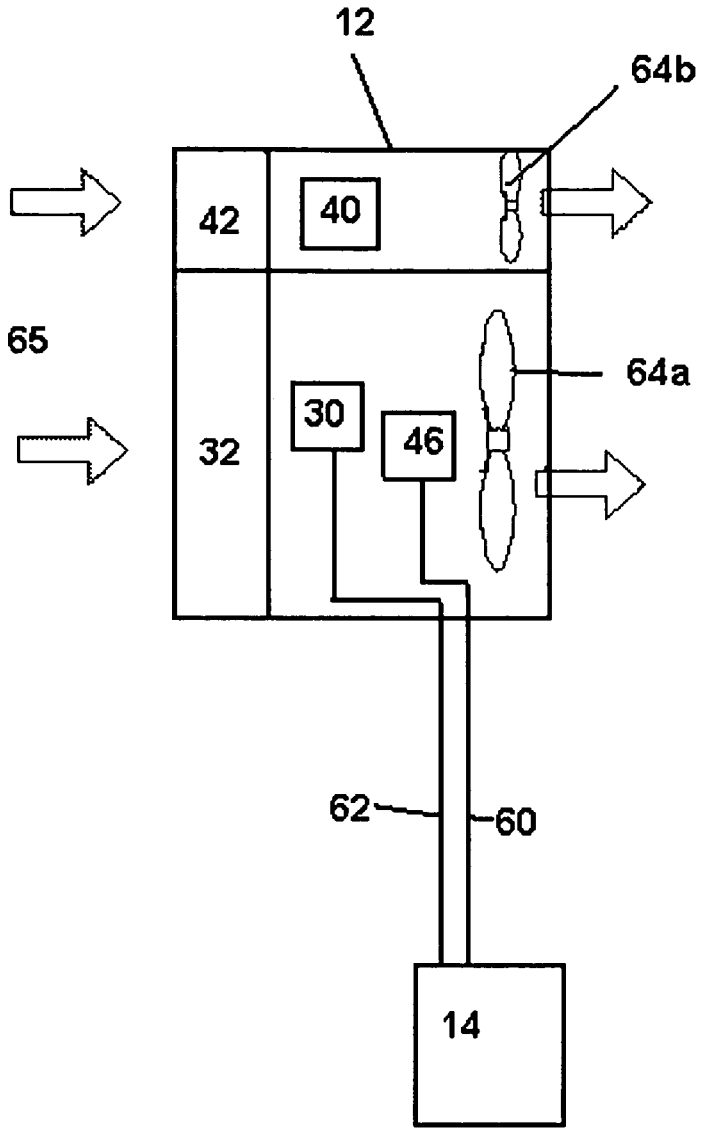
FIG. 5 is a schematic plan view of another embodiment of the condenser unit for the refrigeration system.

The condensing unit is schematically illustrated in FIGS. 5 and 6. In FIG. 5, the condensing unit 12 has main compressor 30 and the secondary or subcooling compressor 40. In some embodiments, main compressor 30 may comprise more than one compressor and/or second compressor 40 may comprise more than one compressor. The main condenser coil 32 uses ambient air 65 to cool hot refrigerant from compressor 30 of the main refrigeration system 20. The secondary condenser 42 uses ambient air 65 to cool hot refrigerant from the secondary compressor 42 of the subcooling refrigeration system 22. The main refrigeration system evaporator 14 is remote from condensing unit 12 and that evaporator with expansion device 34 is connected with field installed insulated piping through liquid line 60 and suction line 62. Evaporator 34 could be a cooling coil in an air stream or a heat exchanger chiller barrel. The subcooling refrigeration system evaporator is subcooling heat exchanger 46 and it cools the liquid line 52 of the main refrigeration system before liquid line 60 leaves condensing unit 60. The suction lines and liquid lines for subcooling compressor 40 and subcooling condenser coil 42 are all factory installed inside condensing unit 12.

The condensing unit 12 utilizes ambient air 65 to cool condenser coil 32 and condenser coil 42 in parallel flow paths. The air moving force comes from condenser fan 64. Condenser fan 64 rejects hot air back to the ambient environment in location 67. The condensing medium can be water from a cooling tower instead of air from the ambient surroundings, but the water flow would be moved by pumps and the flow paths must remain parallel for the two condensers.

An alternate design condensing unit 12 in FIG. 5 uses two condenser fans 64*a* and 64*b* to move ambient air 65 to cool condenser coil 32 and condenser coil 42 in parallel flow paths. The air moving force comes for the main refrigeration system condenser coil 42 comes from condenser fan 64*a*. Condenser fan 64*a* rejects hot air back to the ambient environment. The air moving force comes for the subcooling refrigeration system condenser coil 64 comes from condenser fan 64*b*. Condenser fan 64*b* rejects hot air back to the ambient environment.

High efficiency/low global warming R404A or R507 or R407A or R407C refrigeration systems with internal R32 blend mechanical refrigerant subcooling have specific design criteria that must be followed for reliable operation. These criteria do not lend such systems to fields design and installation. In this invention systems of various cooling capacities can be designed to these criteria and assembled in controlled repetition.

These criteria include:

a. Main condensing Temperature—greater than 20° F. above the subcooling evaporator liquid outlet control temperature. This ensures that there is enough discharge pressure to overcome any pressure drop in the refrigerant subcooling evaporator and the refrigerant liquid lines to the main refrigeration evaporator. The condensing temperature control can be achieved by measuring ambient temperatures, liquid line temperatures, or main refrigeration discharge pressures because the refrigerant sees a condition of saturation in the condenser.

b. Subcooling condensing pressure—less than rating of the refrigeration discharge pipe. For R410A systems the upper limit of saturated condensing temperatures is 120° F. due to the operational limits of copper refrigeration pipe.

c. Subcooling liquid line (R407C)—a liquid system designed to make certain that the subcooling evaporator sees flow of liquid, but not vapor. This means that the liquid line should flow downward out of the condenser at a flow rate no higher than 125 feet per minute. Under 125 feet per minute, the R407C liquid line cannot carry refrigerant vapor downward against gravity as the liquid leaves the condenser. Due to the large temperature glide of R407C, the expansion device will operate in an erratic fashion if any vapor is delivered to this device.

d. Field installed piping—the liquid line (FIG. 1, pipe 60) and the main refrigeration system suction line (FIG. 1, pipe 62).

e. Main refrigeration system liquid line (FIG. 1, pipe 60)—insulated during the field liquid pipe installation to avoid heat gain that would cause a loss of subcooling and therefore a loss of cooling capacity and efficiency.

f. Main refrigeration system expansion device (FIG. 1, expansion device 34)—sized for subcooled refrigerant liquid to avoid expansion valve hunting. In the case of our examples above, the expansion device should be designed for 60° F. refrigerant liquid. In order to avoid field expansion valve sizing errors, the expansion device (FIG. 1, expansion device 34) may be installed in the evaporator (FIG. 1, evaporator 14) at the factory.

g. Subcooling refrigeration system—factory assembled condensing unit with liquid and suction pipe runs less than 10 feet. This avoids issues with refrigerant temperature glide in R407C systems. Long pipe runs can cause refrigerant liquid to flash into vapor and this causes erratic pressures in R407C systems. This avoids issues with increasing pipe sizes to accommodate pressure drops in long runs of R410A. The larger a pipe diameter is, the lower the pressure rating for that pipe.

h. Main and secondary condensers—parallel air paths so neither system rejects heat into the other system's condensing coil in order to maintain minimum discharge pipe pressures and maximum EER numbers.

With these design criteria attended to by design engineers, high efficiency/low global warming R404A or R507 or R407A or R407C refrigeration systems with internal R32 blend mechanical refrigerant subcooling have significant gains in global stewardship over prior art systems. These criteria would not be suited to field design and installation to the level of calculation and the required attention to repeatable construction details.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A refrigeration system comprising: a main refrigeration circuit including a main compressor, a main condenser, a main expansion device, and a main evaporator and circulating a low temperature or medium temperature HFC blend refrigerant; a secondary refrigeration circuit including a secondary compressor, a secondary condenser, a secondary expansion device, and a secondary evaporator and circulating an air conditioning refrigerant of a R-32 blend, said main refrigeration circuit being coupled to a liquid line of said secondary refrigeration circuit; a condenser unit having a housing enclosing said main condenser and said secondary condenser in parallel spaced relation, said main compressor and said secondary compressor, said secondary expansion device and said secondary evaporator; a ventilation inlet and a ventilation outlet in said housing of said condenser unit; fan means in said housing for circulating air between said inlet and said outlet and across said main condenser in parallel flow paths; and conduit means interconnecting said secondary condenser, said secondary compressor, said secondary expansion device and said secondary evaporator.

2. The refrigeration systems as recited in claim 1 wherein said low temperature or medium temperature refrigerant is R404A or R-507 or R407A or R407C.

3. The refrigeration system as recited in claim 1 wherein air conditioning refrigerant is R-410A or R-407C.

4. The refrigeration system as recited in claim 1 wherein a condensing temperature of said main condenser is 20° F. or more above a condensing temperature of the secondary evaporator.

5. The refrigeration system as recited in claim 4 wherein the condensing temperature of said secondary condenser is less than 120° F.

6. The refrigeration system as recited in claim 5 wherein secondary refrigeration system is interconnected with said conduit means not exceeding 10 feet in individual length.

7. The refrigeration system as recited in claim 1 wherein said R32 blend is –407C and said conduit means provides downward liquid flow from said secondary condenser at a flow rate preventing the flow of vapor to said secondary control device.

8. The refrigeration system as recited in claim 4 wherein said flow rate is less than 125 feet per minute.

9. The refrigeration system as recited in claim 1 wherein said main refrigeration circuit is thermally coupled to said secondary refrigeration circuit at said secondary evaporator.

10. The refrigeration system as recited in claim 1 wherein said main compressor comprises two or more compressors.

11. The refrigeration system as recited in claim 1 wherein said secondary compressor comprises two or more compressors.

12. The refrigeration system as recited in claim 1 wherein said HFC blend refrigerant comprises a R32/R125/R134A blend.

13. A method of replacing a refrigeration system and consisting of a condenser unit operatively connected in a refrigeration circuit using R22 as a refrigerant to a remotely located evaporator by a liquid line from a condenser and suction line to a compressor comprising the steps of:

a. removing the refrigerant from the circuit;

b. severing said liquid line and said suction line;

c. removing said condenser unit;

d. providing a replacement condenser unit having a housing enclosing a secondary cooling circuit serially consisting a secondary condenser, secondary compressor, a secondary expansion valve, and a secondary evaporator and carrying a secondary refrigerant having a GWP less than about 2000 and a ODP of substantially 0; said housing further enclosing a replacement compressor having an inlet line and serially connected with a replacement condenser having an outlet line thermally coupled with said secondary evaporator;

e. connecting the severed liquid line to said outlet line and said severed suction line to said inlet line of said replacement condenser unit to provide a replacement main refrigeration circuit; and f. charging said replacement main refrigeration circuit with a replacement refrigerant having a GWP greater than about 3500 and a ODP of substantially 0; wherein said replacement refrigerant comprises a HFC blend refrigerant.

14. The method as recited in claim 13 wherein said secondary refrigerant is an R32 blend.

15. The method as recited in claim 13 wherein said secondary refrigerant is R410A or R407C.

16. The method as recited in claim 13 wherein said replacement refrigerant is R32/R125/R134A blend.

17. The method as recited in claim 13 wherein said replacement refrigerant is R407A OR R407C.

18. The method as recited in claim 13 wherein said secondary compressor comprises more than one compressor.

19. The method as recited in claim 13 wherein said replacement compressor comprises more than one compressor.

* * * * *